US010310407B2

(12) United States Patent
Maezawa

(10) Patent No.: US 10,310,407 B2
(45) Date of Patent: Jun. 4, 2019

(54) DEVELOPMENT DEVICE AND IMAGE FORMING APPARATUS

(71) Applicant: KYOCERA Document Solutions Inc., Osaka (JP)

(72) Inventor: Nobuhiro Maezawa, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/038,954

(22) Filed: Jul. 18, 2018

(65) Prior Publication Data

US 2019/0049876 A1 Feb. 14, 2019

(30) Foreign Application Priority Data

Aug. 14, 2017 (JP) ..... 2017-156417
Jun. 1, 2018 (JP) ..... 2018-105983

(51) Int. Cl.
*G03G 15/00* (2006.01)
*G03G 15/08* (2006.01)
*G03G 21/10* (2006.01)

(52) U.S. Cl.
CPC ..... *G03G 15/0812* (2013.01); *G03G 15/0808* (2013.01); *G03G 15/0818* (2013.01); *G03G 21/10* (2013.01)

(58) Field of Classification Search
USPC ..... 399/107, 110, 111, 119, 120
See application file for complete search history.

(56) References Cited

U.S. PATENT DOCUMENTS 7,103,298 B2 9/2006 Satoh
8,798,501 B2 * 8/2014 Hayashi ..... G03G 15/0173 399/119
9,389,535 B2 * 7/2016 Hotani ..... G03G 15/0812
9,471,010 B2 * 10/2016 Fukuta ..... G03G 15/0898

FOREIGN PATENT DOCUMENTS

JP 2004-252193 A 9/2004

* cited by examiner

*Primary Examiner* — Hoan H Tran
(74) *Attorney, Agent, or Firm* — Studebaker & Brackett PC

(57) ABSTRACT

A development device includes a developer carrier, a blade and a cover. The developer carrier carries a developer containing a toner. The blade regulates a thickness of the developer carried on the developer carrier. The cover includes a cover main body covering an outer side of the blade and a facing rib protruding from an inner face of the cover main body and facing the developer carrier at an interval. A storage space to store the toner which contacts the facing rib and falls is formed below the facing rib.

11 Claims, 6 Drawing Sheets

DEVELOPMENT DEVICE AND IMAGE FORMING APPARATUS

INCORPORATION BY REFERENCE

This application is based on and claims the benefit of priorities from Japanese patent application No. 2017-156417 filed on Aug. 14, 2017 and Japanese patent Application No. 2018-105983, filed on Jun. 1, 2018 which are incorporated by reference in their entirety.

BACKGROUND

The present disclosure relates to a development device and an image forming apparatus including the development device.

An electrophotographic type image forming apparatus conventionally includes a development device. A casing of the development device stores a developer. A toner in the developer is supplied to a surface of an image carrier (for example, a photosensitive drum) to develop an electrostatic latent image formed on the surface of the image carrier.

In the above development device, when the toner in the developer is scattered outside the casing, the scattered toner may contaminate an inner space of the image forming apparatus and exert bad influence on operations of members constituting the image forming apparatus. Then, various methods to inhibit the scattering of the toner from the development device are proposed.

For example, in some cases, outside air is introduced toward an inner space of the casing of the development device through a flow gap formed between the casing of the development device and the surface of the photosensitive drum in order to inhibit the toner scattering from the development device.

SUMMARY

In accordance with an aspect of the present disclosure, a development device includes a developer carrier, a blade and a cover. The developer carrier carries a developer containing a toner. The blade regulates a thickness of the developer carried on the developer carrier. The cover includes a cover main body covering an outer side of the blade and a facing rib protruding from an inner face of the cover main body and facing the developer carrier at an interval. A storage space to store the toner which contacts the facing rib and falls is formed below the facing rib.

In accordance with an aspect of the present disclosure, an image forming apparatus includes the development device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, an image forming apparatus 1 according to an embodiment of the present disclosure will be described. Arrows Fr, Rr, L, R, U and Lo suitably marked in each figure respectively indicate a front side, a rear side, a left side, a right side, an upper side and a lower side of the image forming apparatus 1.

First, an entire structure of the image forming apparatus 1 will be described. The image forming apparatus 1 is a multifunctional peripheral multiply containing a print function, a copying function and a facsimile function, for example.

Figure 1:
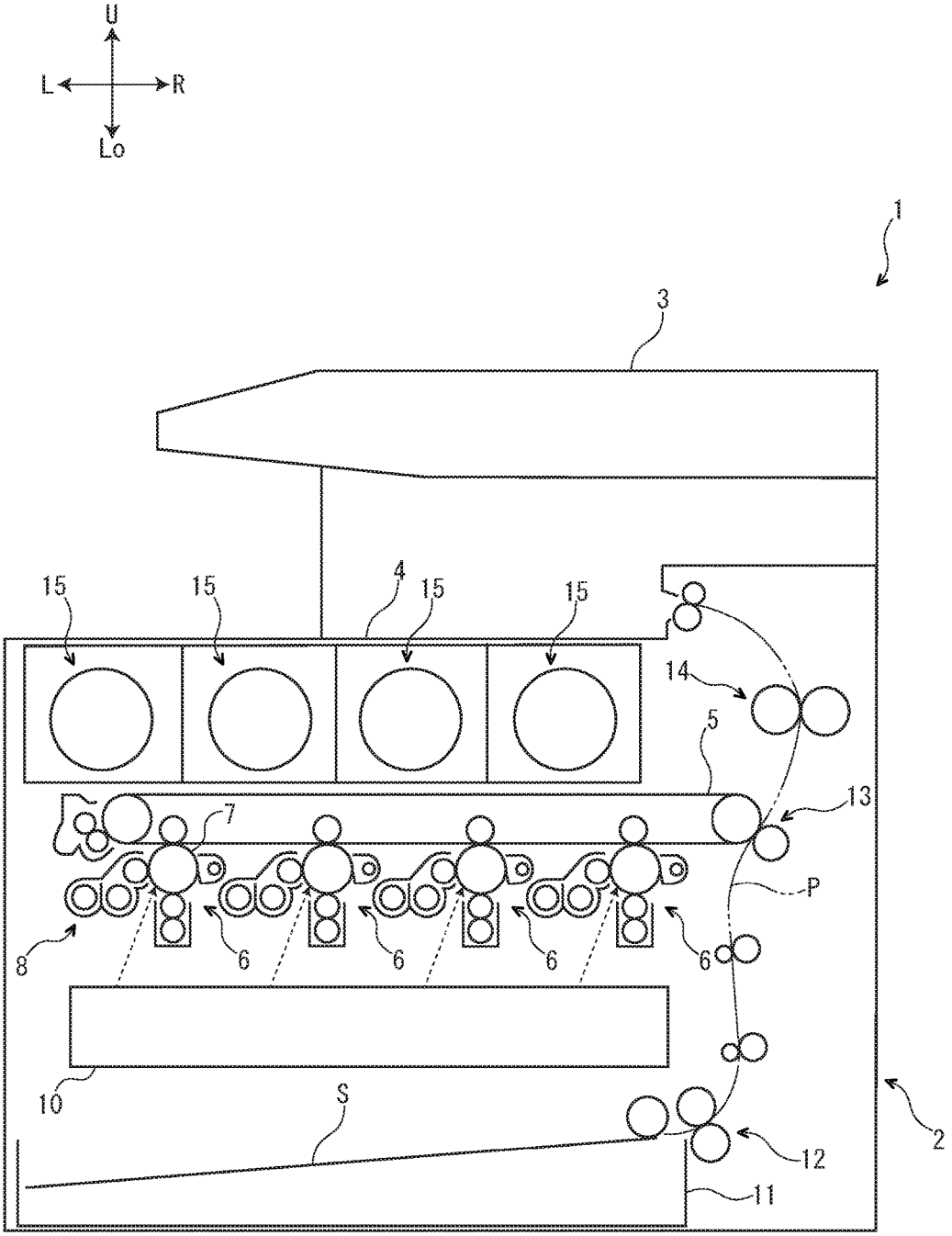
FIG. 1 is a schematic view schematically showing an image forming apparatus according to an embodiment of the present disclosure.

With reference to FIG. 1, the image forming apparatus 1 includes a box-shaped apparatus main body 2. At an upper end portion of the apparatus main body 2, an image reading device 3 configured to read an image of a document is provided.

In an upper portion of the apparatus main body 2, an ejected sheet tray 4 is provided. In an approximately center portion of the apparatus main body 2, an intermediate transferring belt 5 and four image forming parts 6 are stored. Each image forming part 6 includes a photosensitive drum 7 (an example of an image carrier) and a development device 8. In a lower portion of the apparatus main body 2, an exposure device 10 is stored. In a lower end portion of the apparatus main body 2, a sheet feeding cassette 11 storing a sheet S (an example of a recording medium) is stored.

In a right side portion of the apparatus main body 2, a conveying path P for the sheet S is provided. At an upstream side end portion of the conveying path P, a sheet feeding part 12 is provided. At a midstream portion of the conveying path P, a secondary transferring part 13 is provided. Ata downstream portion of the conveying path P, a fixing device 14 is provided.

In the upper portion of the apparatus main body 2, four toner containers 15 are stored below the ejected sheet tray 4. The toner containers 15 respectively store a toner of different colors (for example, black, cyan, magenta and yellow).

Next, an example of an operation of the image forming apparatus 1 will be described.

First, a laser (refer to a dotted line arrow in FIG. 1) from the exposure device 10 forms an electrostatic latent image on the photosensitive drum 7 of each image forming part 6. The development device 8 of each image forming part 6 develops the above electrostatic latent image. Thereby, a toner image is carried on the photosensitive drum 7 of each image forming part 6. The toner image is primarily transferred on the intermediate transferring belt 5 from the photosensitive drum 7 of each image forming part 6. Thereby, a full color toner image is formed on the intermediate transferring belt 5.

On the other hand, the sheet S fed from the sheet feeding cassette 11 by the sheet feeding part 12 is conveyed to a downstream side along the conveying path P and then enters the secondary transferring part 13. At the secondary transferring part 13, the full color toner image formed on the intermediate transferring belt 5 is secondarily transferred on the sheet S. The sheet S on which the toner image is secondarily transferred is further conveyed to the downstream side along the conveying path P and then enters the fixing device 14. The fixing device 14 fixes the toner image on the sheet S. The sheet S on which the toner image is fixed is ejected on the ejected sheet tray 4.

Next, the development device 8 will be further described.

Figure 2:
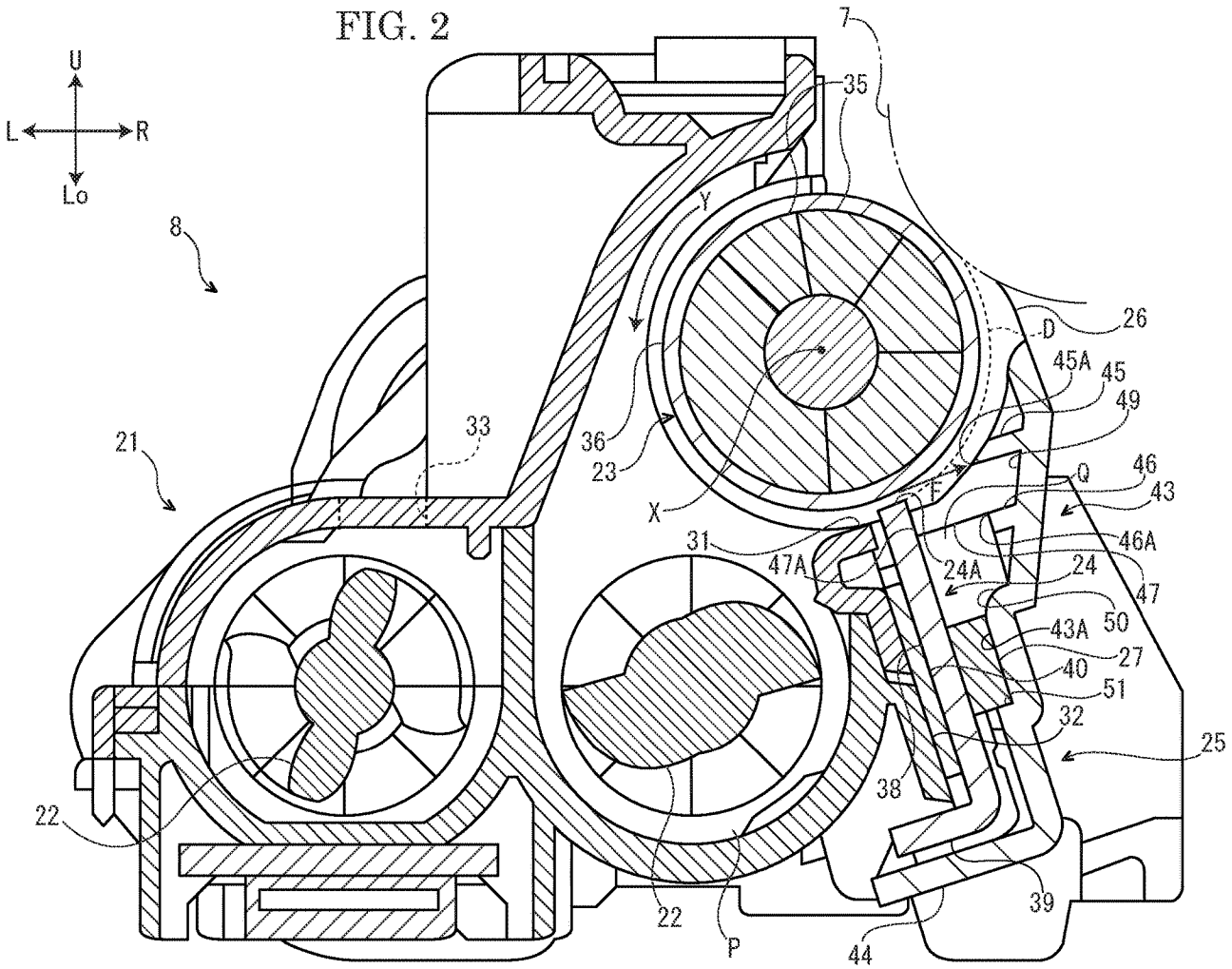
FIG. 2 is a sectional view showing a development device according to the embodiment of the present disclosure.

With reference to FIG. 2, the development device 8 includes a casing 21, a pair of left and right agitating screws 22 stored in a lower portion of the casing 21, a magnetic roller 23 (an example of a developer carrier) provided at a right upper side of the right agitating screw 22, a blade 24 provided at a right side of the casing 21, a cover 25 provided from a right side to a lower side of the blade 24, a seal member 26 fixed to an upper end portion of the cover 25 and an elastic member 27 provided between the blade 24 and the cover 25.

The casing 21 of the development device 8 has a box-like shape elongated in a front-and-rear direction. An inner space P of the casing 21 stores a two-component developer (hereinafter, called as "a developer" simply) containing a non-magnetic toner and a magnetic carrier. That is, the development device 8 employs a two-component development method.

On a right face of the casing 21, an opening part 31 is provided. On the right face of the casing 21, an attachment face 32 is provided below the opening part 31. On a left side portion of an upper face of the casing 21, a replenishment port 33 is provided. Through the replenishment port 33, the toner is replenished from the corresponding toner container 15 (refer to FIG. 1) to the inner space P of the casing 21.

With reference to FIG. 2, the pair of left and right agitating screws 22 each has a shape elongated in the front-and-rear direction. Each agitating screw 22 is stored in the inner space P of the casing 21. Each agitating screw 22 is rotatably supported by the casing 21.

The magnetic roller 23 of the development device 8 has a shape elongated in the front-and-rear direction. A left side portion of the magnetic roller 23 is stored in the inner space P of the casing 21. A right side portion of the magnetic roller 23 is exposed to an outside of the casing 21 through the opening part 31 of the casing 21.

The magnetic roller 23 includes a plurality of magnetic poles 35 and a sleeve 36 covering an outer circumference of the plurality of magnetic poles 35. The plurality of magnetic poles 35 are fixed to the casing 21. The sleeve 36 rotates along a rotation direction Y around a rotation axis X extending along the front-and-rear direction. That is, in the present embodiment, the front-and-rear direction is a rotation axis direction of the sleeve 36. An outer circumferential face of the sleeve 36 faces an outer circumferential face of the photosensitive drum 7 at an interval.

The blade 24 of the development device 8 has a shape elongated in the front-and-rear direction. The blade 24 has an L-shaped cross section. A tip end portion 24A (an upper end portion) of the blade 24 faces the outer circumferential face of the sleeve 36 of the magnetic roller 23 at an interval.

The blade 24 includes a main body plate 38 extending to a right lower side and a bent plate 39 bent from a lower end portion of the main body plate 38 to a left lower side. The main body plate 38 is attached to the attachment face 32 of the casing 21 via an elastic body 40 made of sponge. An outer face of the main body plate 38 is flat.

Figure 3:
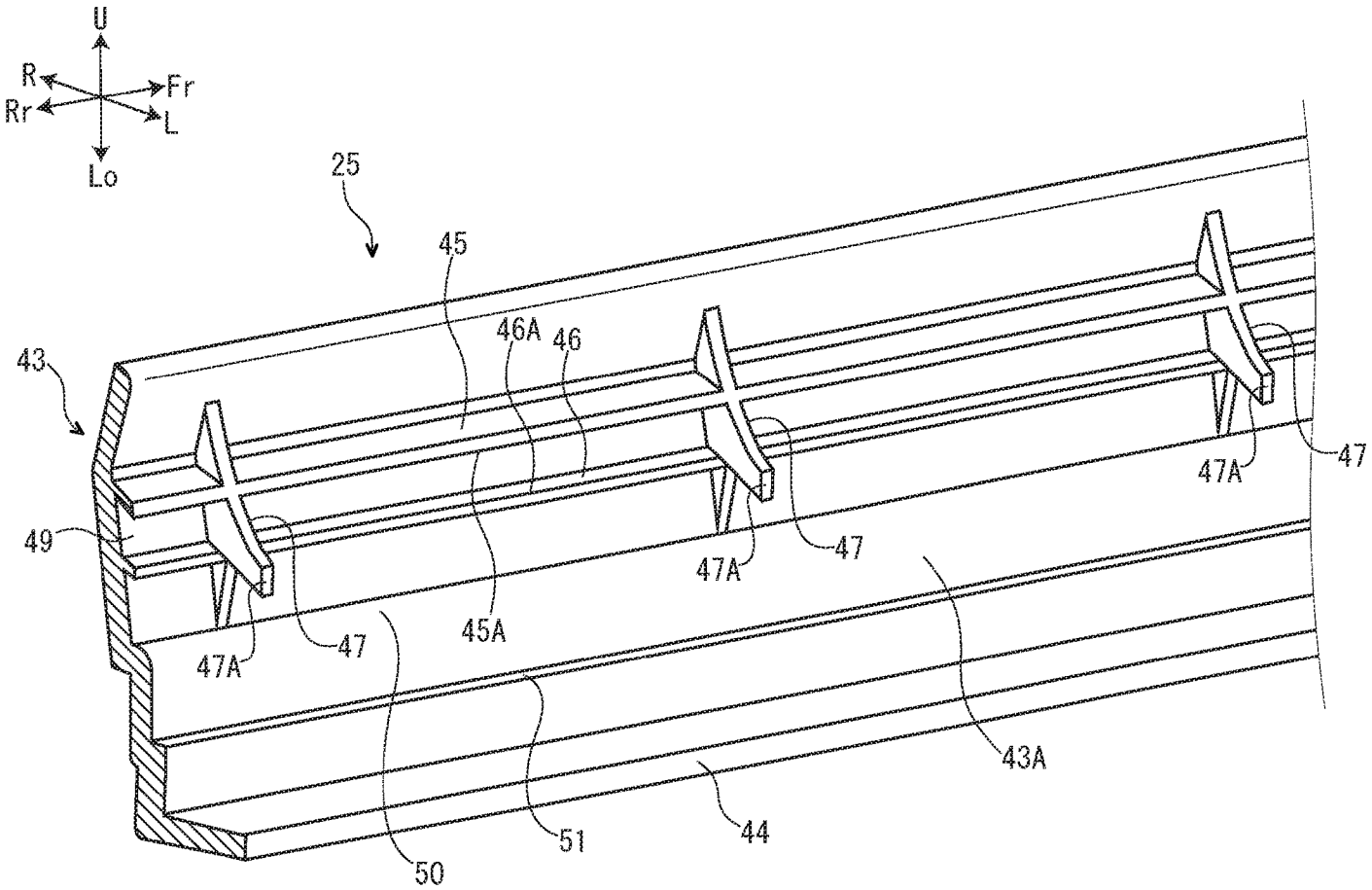
FIG. 3 is a perspective sectional view showing a cover according to the embodiment of the present disclosure.
Figure 4:
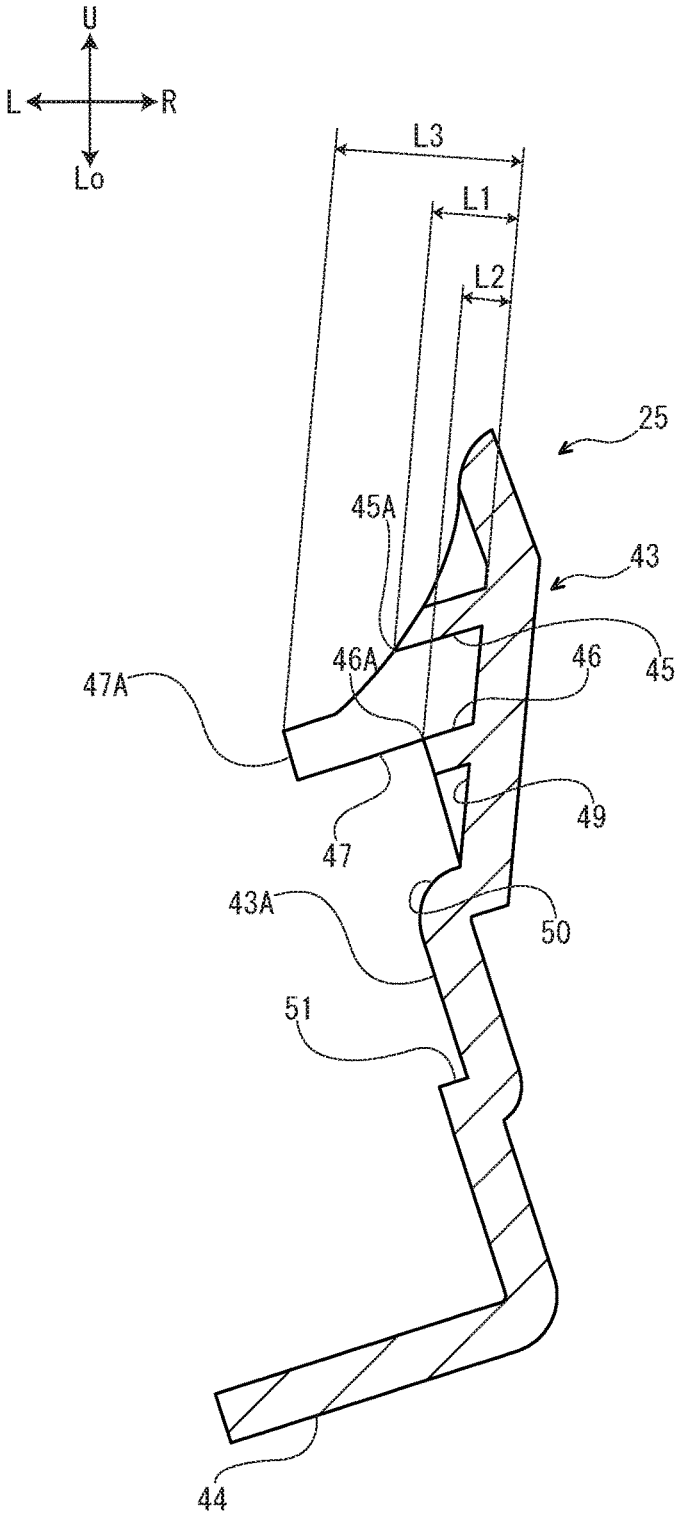
FIG. 4 is a sectional view showing the cover according to the embodiment of the present disclosure.

With reference to FIG. 2 to FIG. 4, the cover 25 of the development device 8 includes a cover main body 43 extending along an upper-and-lower direction, a bent piece 44 bent from a lower end portion of the cover main body 43 to a left lower side, and a facing rib 45 and a reinforcement rib 46 and a plurality of restriction ribs 47 which are protruded from an inner face 43A of the cover main body 43. All of the cover main body 43, the bent piece 44 and the ribs 45 to 47 are integrally formed.

The cover main body 43 of the cover 25 covers an outer side of the blade 24. On an upper portion of the inner face 43A of the cover main body 43, a recess 49 is provided. On a center portion in the upper-and-lower direction of the inner face 43A of the cover main body 43, a curved face 50 is provided at a lower end side of the recess 49. On a lower portion of the inner face 43A of the cover main body 43, a stepped portion 51 is provided.

The bent piece 44 of the cover 25 covers a lower side of the blade 24. An upper face of the bent piece 44 faces a lower face of the bent plate 39 of the blade 24 at an interval.

The facing rib 45 of the cover 25 extends from a front end side to a rear end side of the cover 25 along the front-and-rear direction. The facing rib 45 protrudes from the recess 49 of the cover main body 43 to a left lower side. A protruding length L1 of the facing rib 45 from the recess 49 is from 0.1 mm to 3.0 mm inclusive. The facing rib 45 inclines to a lower side toward its tip end side. The facing rib 45 does not come into contact with the blade 24.

A tip end portion 45A of the facing rib 45 of the cover 25 faces the outer circumferential face of the sleeve 36 of the magnetic roller 23 at an interval. The tip end portion 45A of the facing rib 45 is positioned at a downstream side of the tip end portion 24A of the blade 24 in the rotation direction Y of the sleeve 36. The tip end portion 45A of the facing rib 45 is positioned above the tip end portion 24A of the blade 24.

With reference to FIG. 2, below the facing rib 45 of the cover 25, a storage space Q to store the developer which contacts the facing rib 45 and then falls is formed. An upper face of the storage space Q is opened. A bottom face of the storage space Q is constituted by an upper face of the elastic member 27 and the curved face 50 of the cover main body 43. An inner face of the storage space Q is constituted by the outer face of the main body plate 38 of the blade 24. An outer face of the storage space Q is constituted by the recess 49 of the cover main body 43. The storage space Q is provided outside the inner space P of the casing 21.

The reinforcement rib 46 of the cover 25 extends from the front end side to the rear end side of the cover 25 along the front-and-rear direction. The reinforcement rib 46 protrudes below the facing rib 45 from the recess 49 of the cover main body 43 to a left lower side. A protruding length L2 of the reinforcement rib 46 from the recess 49 is shorter than the protruding length L1 of the facing rib 45 from the recess 49. The reinforcement rib 46 is provided parallel to the facing rib 45 and is inclined to a lower side toward its tip end side. The reinforcement rib 46 does not comes into contact with the blade 24. The reinforcement rib 46 is arranged inside the storage space Q. A tip end portion 46A of the reinforcement rib 46 is positioned below the tip end portion 24A of the blade 24.

With reference to FIG. 2 to FIG. 4, the plurality of restriction ribs 47 of the cover 25 are provided at intervals in the front-and-rear direction. Each restriction rib 47 extends along the upper-and-lower direction, and couples the facing rib 45 to the reinforcement rib 46. Each restriction rib 47 protrudes from the recess 49 of the cover main body 43 to a left lower side. A protruding length L3 of each restriction rib 47 from the recess 49 is longer than the protruding length L1 of the facing rib 45 from the recess 49 and the protruding length L2 of the reinforcement rib 46 from the recess 49.

A tip end portion 47A of each restriction rib 47 is flat, and comes into surface contact with the outer face of the main body plate 38 of the blade 24. The tip end portion 47A of each restriction rib 47 is positioned below the tip end portion 24A of the blade 24.

With reference to FIG. 2, the seal member 26 of the development device 8 has a shape elongated in the front-and-rear direction. The seal member 26 is made of sheet-like film, for example. A lower end portion of the seal member 26 is fixed to an upper end portion of an outer face of the cover main body 43 of the cover 25. An upper end portion of the seal member 26 comes into contact with the outer circumferential face of the photosensitive drum 7.

The elastic member 27 of the development device 8 has a shape elongated in the front-and-rear direction. The elastic member 27 is made of sponge material, for example. The elastic member 27 has a rectangular cross section. An inner face of the elastic member 27 comes into contact with the outer face of the main body plate 38 of the blade 24. An outer face of the elastic member 27 comes into contact with the inner face 43A of the cover main body 43 of the cover 25. That is, the elastic member 27 is arranged between the main body plate 38 of the blade 24 and the cover main body 43 of the cover 25. A lower face of the elastic member 27 comes into contact with the stepped portion 51 of the cover main body 43 of the cover 25.

When the development device 8 configured as described above develops the electrostatic latent image formed on the photosensitive drum 7, each agitating screw 22 and the sleeve 36 of the magnetic roller 23 are rotated. When each agitating screw 22 is thus rotated, the developer stored in the inner space P of the casing 21 is agitated by each agitating screw 22 and then charged.

The charged developer is brought up by magnetic force of the plurality of magnetic poles 35 of the magnetic roller 23 and then carried by the sleeve 36 of the magnetic roller 23. The developer carried by the sleeve 36 is conveyed by the sleeve 36 along the rotation direction Y and its thickness is regulated by the tip end portion 24A of the blade 24. The developer whose thickness is regulated is further conveyed by the sleeve 36 along the rotation direction Y and introduced to a facing area between the sleeve 36 and the photosensitive drum 7. Then, depending on a voltage difference between the sleeve 36 and the photosensitive drum 7, the toner in the developer is adhered on the electrostatic latent image formed on the photosensitive drum 7. That is, the toner is supplied from the sleeve 36 to the photosensitive drum 7. Thereby, the electrostatic latent image formed on the photosensitive drum 7 is developed.

By the way, as the sleeve 36 is rotated as described above, the developer is passed through a facing area between the tip end portion 24A of the blade 24 and the outer circumferential face of the sleeve 36. This generates an air flow containing the toner (refer to an arrow F in FIG. 2). If the air flow is discharged outside the development device 8, the toner contained in the air flow is scattered outside the development device 8 and an inner space of the image forming apparatus 1 may be contaminated with the toner.

Then, the present embodiment is configured that the facing rib 45 of the cover 25 faces the outer circumferential face of the sleeve 36 at an interval. By applying such a configuration, it becomes possible to slow down a flow rate of the air flow containing the toner greatly by hitting the air flow against the facing rib 45 and to make the toner in the air flow fall. Thereby, it becomes possible to inhibit the toner scattering from the development device 8.

Additionally, an interval between the tip end portion 45A of the facing rib 45 and the outer circumferential face of the sleeve 36 becomes narrow by the developer (refer to a dotted line D in FIG. 2) carried on the outer circumferential face of the sleeve 36. Thereby, the air flow containing the toner is hardly passed through the above interval so that it becomes possible to hit most of the air flow against the facing rib 45.

Additionally, below the facing rib 45, the storage space Q to store the toner which contacts the facing rib 45 and then falls is formed. Thereby, it becomes possible to store the toner which contacts the facing rib 45 and then falls, inside the development device 8 surely and to inhibit the toner scattering from the development device 8 more surely.

Additionally, the cover 25 includes not only the facing rib 45 but also the reinforcement rib 46. By applying such a configuration, it becomes possible to improve a strength of the cover 25. Additionally, the protruding length L2 of the reinforcement rib 46 from the recess 49 of the cover main body 43 is shorter than the protruding length L1 of the facing rib 45 from the recess 49 of the cover main body 43. By applying such a configuration, it becomes possible to prevent the introduction of the toner to the storage space Q from being inhibited by the reinforcement rib 46.

Additionally, the tip end portion 45A of the facing rib 45 is positioned above the tip end portion 24A of the blade 24. By applying such a configuration, it becomes possible to hit the air flow containing the toner against the facing rib 45 surely. The tip end portion 46A of the reinforcement rib 46 is positioned below the tip end portion 24A of the blade 24. By applying such a configuration, compared with a case where both the tip end portion 45A of the facing rib 45 and the tip end portion 46A of the reinforcement rib 46 are positioned above the tip end portion 24A of the blade 24, it becomes possible to make an interval between the facing rib 45 and the reinforcement rib 46 wide. Then, it becomes possible to further improve the strength of the cover 25.

Additionally, the facing rib 45 and the reinforcement rib 46 extend along the front-and-rear direction (the rotation axis direction of the sleeve 36). By applying such a configuration, it becomes possible to further improve the strength of the cover 25.

Additionally, the cover 25 further includes the plurality of restriction ribs 47 protruding from the inner face of the cover main body 43, and each restriction rib 47 comes into contact with the blade 24. By applying such a configuration, it becomes possible to inhibit the cover main body 43 from being deflected inward and to inhibit a leakage of the toner from a periphery of the cover 25.

Additionally, the tip end portion 47A of each restriction rib 47 is flat, and comes into surface contact with the outer face of the main body plate 38 of the blade 24. By applying such a configuration, the tip end portion 47A of each restriction rib 47 is allowed to come into contact with the outer face of the main body plate 38 of the blade 24 stably.

Additionally, the plurality of restriction ribs 47 are provided in the front-and-rear direction (the rotation axis direction of the sleeve 36) at intervals, each restriction rib 47 extends along the upper-and-lower direction (a direction perpendicular to the rotation axis direction of the sleeve 36), and is coupled to the facing rib 45. By applying such a configuration, it becomes possible to further improve the strength of the cover 25.

Additionally, the protruding length L1 of the facing rib 45 from the recess 49 of the cover main body 43 is from 0.1 mm to 3.0 mm inclusive. By making the protruding length L1 0.1 mm or longer as described above, it becomes possible to improve a function to slow the air flow rate down by the facing rib 45. By making the protruding length L1 3.0 mm or shorter as described above, it becomes possible to inhibit the tip end portion 45A of the facing rib 45 from coming into contact with the developer (refer to the dotted line D in FIG. 2) carried on the outer circumferential face of the sleeve 36.

Additionally, a part of the bottom face of the storage space Q is constituted by the elastic member 27. By applying such a configuration, varying a shape and a size of the elastic member 27 makes it possible to vary a volume of the storage space Q freely.

Additionally, the image forming apparatus 1 includes the above development device 8. By applying such a configuration, it becomes possible to provide the image forming apparatus 1 capable of inhibiting the toner scattering from the development device 8.

Figure 5:
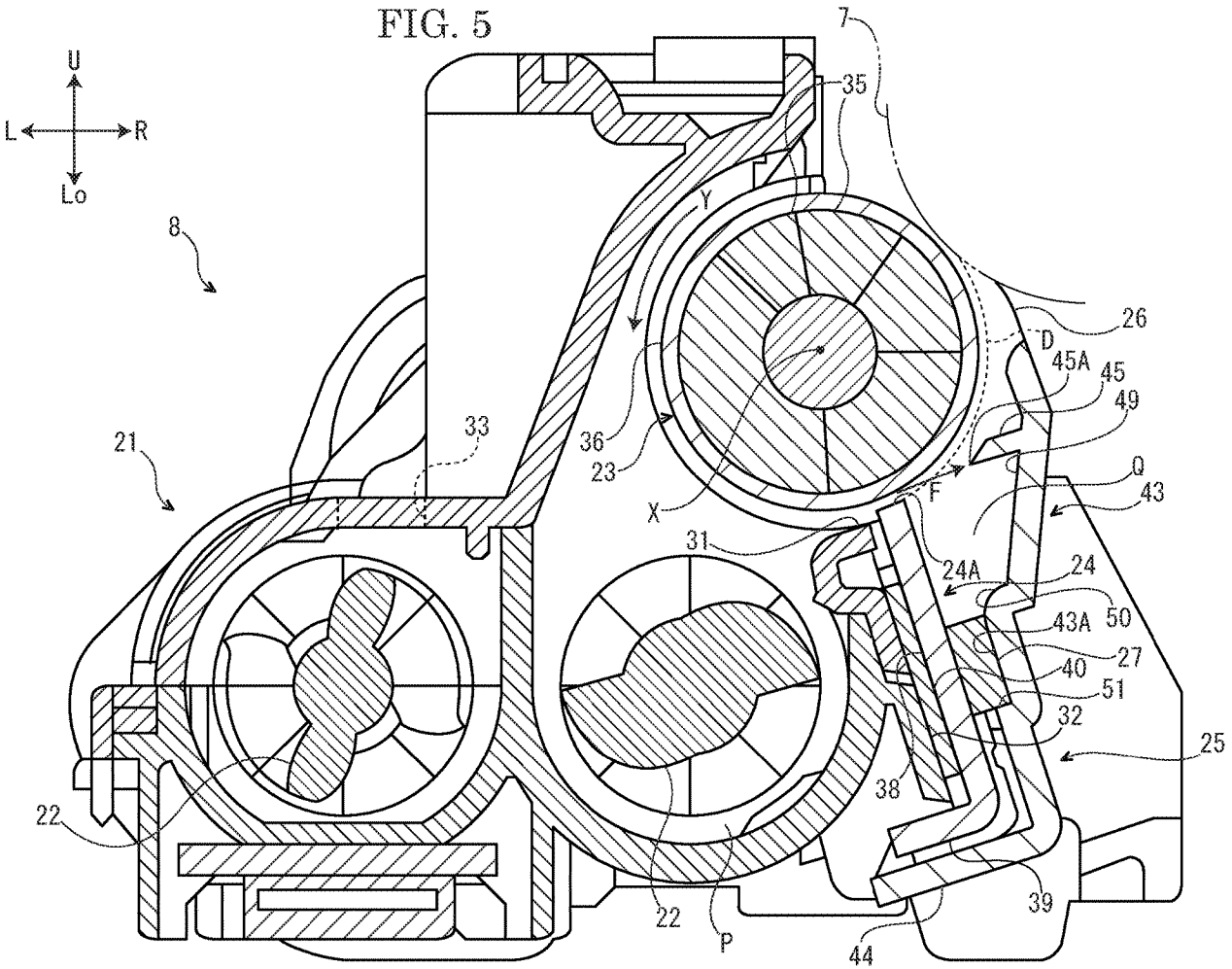
FIG. 5 is a sectional view showing the development device according to another embodiment of the present disclosure.

In the present embodiment, the cover 25 includes the reinforcement rib 46 protruding from the recess 49 of the cover main body 43 below the facing rib 45. On the other hand, in other embodiments, as shown in FIG. 5, the cover 25 may not include another rib protruding from the recess 49 of the cover main body 43 below the facing rib 45. In other words, the recess 49 of the cover main body 43 may be flat below the facing rib 45. By applying such a configuration, it becomes possible to make the volume of the storage space Q large.

In the present embodiment, the facing rib 45 protrudes from the recess 49 of the inner face 43A of the cover main body 43. On the other hand, in other embodiments, the facing rib 45 may protrude from a portion other than the recess 49 of the inner face 43A of the cover main body 43. This is similar to the reinforcement rib 46 and each restriction rib 47.

Figure 6:
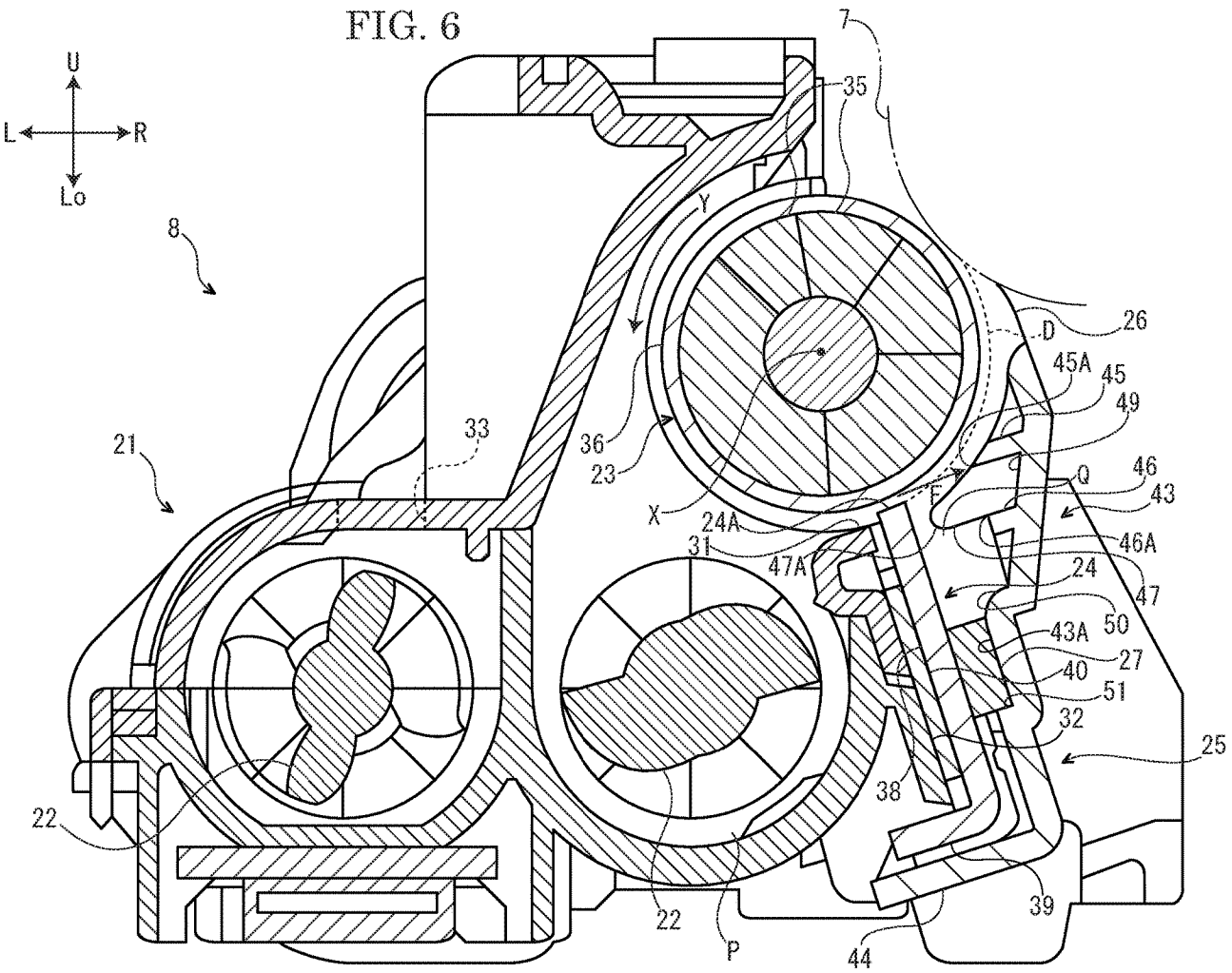
FIG. 6 is a sectional view showing the development device according to still another embodiment of the present disclosure.

In the present embodiment, the tip end portion 47A of each restriction rib 47 is flat. On the other hand, in other embodiments, as shown in FIG. 6, the tip end portion 47A of each restriction rib 47 may be curved.

In the present embodiment, each restriction rib 47 comes into contact with the blade 24. On the other hand, in other embodiments, each restriction rib 47 may face the blade 24 at an interval.

In the present embodiment, the two-component developer containing the toner and the carrier is employed as the developer. On the other hand, in other embodiments, a one-component developer containing the toner only may be employed as the developer.

In the present embodiment, the toner is directly supplied from the magnetic roller 23 to the photosensitive drum 7. On the other hand, in other embodiments, the toner may be supplied from the magnetic roller 23 to the photosensitive drum 7 via another roller.

In the present embodiment, the image forming apparatus 1 is a multifunctional peripheral. On the other hand, in other embodiments, the image forming apparatus 1 may be a printer, a copying machine and a facsimile.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A development device comprising:

a developer carrier carrying a developer containing a toner;

a blade regulating a thickness of the developer carried on the developer carrier; and a cover including:

a cover main body covering an outer side of the blade; and a facing rib protruding from an inner face of the cover main body and facing the developer carrier at an interval, wherein a storage space to store the toner which contacts the facing rib and falls is formed below the facing rib, the cover further includes a reinforcement rib protruding from the inner face of the cover main body below the facing rib, and a protruding length of the reinforcement rib from the inner face of the cover main body is shorter than a protruding length of the facing rib from the inner face of the cover main body.

2. The development device according to claim 1, wherein a tip end portion of the blade faces the developer carrier at an interval, a tip end portion of the facing rib is positioned above the tip end portion of the blade, and a tip end portion of the reinforcement rib is positioned below the tip end portion of the blade.

3. The development device according to claim 1, wherein the developer carrier includes a sleeve rotating around a rotation axis, and the facing rib and the reinforcement rib extend along a rotation axis direction of the sleeve.

4. The development device according to claim 1, further comprising an elastic member arranged between the blade and the cover main body, wherein at least a part of a bottom face of the storage space is constituted by the elastic member.

5. The development device according to claim 4, wherein a curved face is formed on the inner face of the cover main body, and the bottom face of the storage space is constituted by an upper face of the elastic member and the curved face.

6. The development device according to claim 5, wherein a recess is formed on the inner face of the cover main body, the curved face is provided at a lower end side of the recess, and the facing rib protrudes from the recess.

7. An image forming apparatus comprising the development device according to claim 1.

8. A development device comprising:

a developer carrier carrying a developer containing a toner;

a blade regulating a thickness of the developer carried on the developer carrier; and a cover including:

a cover main body covering an outer side of the blade; and a facing rib protruding from an inner face of the cover main body and facing the developer carrier at an interval, wherein a storage space to store the toner which contacts the facing rib and falls is formed below the facing rib, the cover further includes a restriction rib protruding from the inner face of the cover main body, and the restriction rib comes into contact with the blade.

9. The development device according to claim 8, wherein a tip end portion of the restriction rib is flat and comes into surface contact with an outer face of the blade.

10. The development device according to claim 8, wherein the developer carrier includes a sleeve rotating around a rotation axis, and the facing rib extends along a rotation axis direction of the sleeve, a plurality of restriction ribs are provided at an interval in the rotation axis direction, and the plurality of restriction ribs extend along a direction perpendicular to the rotation axis direction and are coupled to the facing rib.

11. A development device comprising:

a developer carrier carrying a developer containing a toner;

a blade regulating a thickness of the developer carried on the developer carrier; and a cover including:

a cover main body covering an outer side of the blade; and a facing rib protruding from an inner face of the cover main body and facing the developer carrier at an interval, wherein a storage space to store the toner which contacts the facing rib and falls is formed below the facing rib, and a protruding length of the facing rib from the inner face of the cover main body is from 0.1 mm to 3.0 mm inclusive.

* * * * *